US010829971B2

(12) United States Patent
Murray et al.

(10) Patent No.: US 10,829,971 B2
(45) Date of Patent: Nov. 10, 2020

(54) INCLINED PATCH FITTING COVER

(71) Applicant: ASSA ABLOY Accessories and Door Controls Group, Inc., New Haven, CT (US)

(72) Inventors: Kyle R. Murray, Somerset, PA (US); Douglas Thompson, Somerset, PA (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 0 days.

(21) Appl. No.: 16/141,097

(22) Filed: Sep. 25, 2018

(65) Prior Publication Data

US 2019/0226256 A1 Jul. 25, 2019

Related U.S. Application Data

(60) Provisional application No. 62/621,717, filed on Jan. 25, 2018.

(51) Int. Cl.

| | |
|---|---|
| ***E05D 15/00*** | (2006.01) |
| ***E06B 3/02*** | (2006.01) |
| ***E05D 11/00*** | (2006.01) |
| ***E05D 5/02*** | (2006.01) |
| ***E05D 7/081*** | (2006.01) |

(52) U.S. Cl.

CPC ..... *E05D 15/00* (2013.01); *E05D 5/0246* (2013.01); *E05D 7/081* (2013.01); *E05D 11/0054* (2013.01); *E06B 3/02* (2013.01); *E05Y 2201/11* (2013.01); *E05Y 2600/502* (2013.01); *E05Y 2900/132* (2013.01); *Y10T 16/534* (2015.01)

(58) Field of Classification Search

CPC . Y10T 16/533; Y10T 16/5335; Y10T 16/534; E05D 15/00; E05D 5/0246; E05D 7/08; E05D 11/0054; E06B 3/02; E05Y 2900/132; A47K 3/36

USPC ..... 16/250, 251, 252; 49/388

See application file for complete search history.

(56) References Cited

U.S. PATENT DOCUMENTS

| | | | | |
|---|---|---|---|---|
| D12,974 S | | 6/1882 | Thomas | |
| D313,170 S | | 12/1990 | Nye | |
| D411,441 S | | 6/1999 | Bouquot et al. | |
| D421,147 S | | 2/2000 | Herst et al. | |
| 6,070,294 A | * | 6/2000 | Perkins | A47K 3/36 16/250 |

(Continued)

FOREIGN PATENT DOCUMENTS

| | | | | |
|---|---|---|---|---|
| GB | 1093512 A | * | 12/1967 | E05D 15/00 |
| JP | D1087350 | | 10/2000 | |

(Continued)

OTHER PUBLICATIONS

U.S. Appl. No. 29/634,848, filed Jan. 25, 2018, Griswold.

(Continued)

*Primary Examiner* — William L Miller

(74) *Attorney, Agent, or Firm* — Wolf, Greenfield & Sacks, P.C.

(57) ABSTRACT

A patch fitting cover or cap for a patch fitting creates a substantially continuous surface toward a glass door pane using an inclined wall of the cover/cap. The patch fitting cover may be attached to a patch fitting to improve the accessibility of an associated glass door. The cover may be constructed as a retrofit cover to replace an existing patch fitting cover. The cap may be constructed to cooperate with an existing patch fitting cover such that the cap is installed on the existing patch fitting cover.

22 Claims, 8 Drawing Sheets

(56) References Cited

U.S. PATENT DOCUMENTS

| | | | | |
|---|---|---|---|---|
| 6,519,811 | B1 * | 2/2003 | Cheng | E05D 5/0246 16/252 |
| 6,766,561 | B1 * | 7/2004 | Cheng | E05D 5/0246 16/235 |
| D503,058 | S | 3/2005 | Loewenthal | |
| 6,912,818 | B2 | 7/2005 | Sprague | |
| D535,035 | S | 1/2007 | Ohanesian | |
| 7,305,797 | B2 * | 12/2007 | Chiang | E05D 5/0246 16/252 |
| 7,673,373 | B2 * | 3/2010 | Chang | E05D 5/0246 16/250 |
| D644,784 | S | 9/2011 | Monteix et al. | |
| D668,930 | S | 10/2012 | Tien | |
| 8,528,169 | B1 | 9/2013 | Yu | |
| 8,578,557 | B2 | 11/2013 | Yu | |
| D753,412 | S | 4/2016 | Anderson | |
| 2007/0119108 | A1 | 5/2007 | Downard | |
| 2007/0193148 | A1 | 8/2007 | Simko et al. | |
| 2018/0327986 | A1 | 11/2018 | Cook | |

FOREIGN PATENT DOCUMENTS

| | | | | |
|---|---|---|---|---|
| JP | D1448452 | 8/2012 | | |
| WO | WO-2005007981 A2 * | 1/2005 | | E05D 5/0246 |

OTHER PUBLICATIONS

U.S. Appl. No. 29/634,849, filed Jan. 25, 2018, Griswold.

[No Author Listed] CRL Glass Entrance System Door Rails. C. R. Laurence Company. https://dkhstatic.blob.core.windows.net/products/5395/catalogs/AH11-091114_26.pdf, 2017, 1 page.

[No Author Listed] Door Rails. ASSA ABLOY. https://www.assaabloyglass.us/en/local/assaabloyglassus/products/door-rails/, 2017, 2 pages.

[No Author Listed] DRS Rail System—With Sidelites. Dorma. https://www.dormakaba.com/resource/blob/194758/00a5abed79a09d0727106e567485ff7/934804-ins-drs-rail-sl-0416-pdf-data.pdf, 2016, 8 pages.

[No Author Listed] Glass Solutions 2017 Price List Brought to You by ASSA ABLOY. ASSA ABLOY. https://accesshardware.com/wp-content/uploads/2017/07/Assa-Abloy-Glass-Solutions-Price-Book.pdf, 2017, 34 pages.

[No Author Listed] Glass Solutions Brought to You by ASSA ABLOY. ASSA ABLOY. https://www.assaabloylibrary.us/glasssolutions/ASSA-ABLOY-Glass-Solutions-Full-Line-Catalog/1/, 2017, 74 pages.

[No Author Listed] Produt Listing for CRL Brushed Stainless Anodized End Cap for 4" Tapered 1/2" Glass Wedge-Lock Door Rail by CR Laurence. Amazon.com. https://www.amazon.com/Brushed-Stainless-Anodized-Wedge-Lock-Laurence/dp/B0064OWFWM, 2012, 4 pages.

* cited by examiner

INCLINED PATCH FITTING COVER

RELATED APPLICATIONS

This Application claims the benefit under 35 USC 119(e) of U.S. Application Ser. No. 62/621,717, filed Jan. 25, 2018, titled "INCLINED PATCH FITTING COVER", which is hereby incorporated by reference in its entirety.

Disclosed embodiments are related to patch fittings for glass doors.

BACKGROUND

Patch fittings are conventionally used to hold plate glass door panes (or other transparent, translucent or opaque panels) in a doorway opening or for use as a wall partition. Usually, the patch fitting runs along a portion of one or more edges of the pane and secures the pane to a pivot point via one or more clamps. The patch fitting may also include an accessory space for receiving and retaining door hardware such as mounting hardware, locking hardware, or closing hardware.

SUMMARY

A patch fitting cover for a patch fitting. The patch fitting is operatively couplable to a door pane. The patch fitting cover includes a body constructed and arranged to cover an external region of the patch fitting. The body includes an inclined wall inclined relative to a vertical axis of the glass door pane when the door pane is coupled to the patch fitting. The body also includes a leading edge substantially orthogonal relative to the door pane. The body also has a vertical wall. The inclined wall adjoins an uppermost region of the vertical wall. The vertical wall, inclined wall and leading edge form a substantially continuous surface to provide a gradual transition to the door pane when the door pane is coupled to the patch fitting. The patch fitting cover also includes at least one mounting arrangement constructed and arranged to attach the patch fitting cover to the patch fitting.

A patch fitting cap for a patch fitting cover. The patch fitting cover is operatively coupled to a patch fitting. The patch fitting is operatively couplable to a door pane and the patch fitting cover is operatively couplable to a patch fitting. The patch fitting cap includes an inclined wall and a leading edge. The inclined wall is inclined relative to a vertical axis of the door pane when the door pane is coupled to the patch fitting. The leading edge is substantially orthogonal relative to the door pane when the door pane is coupled to the patch fitting. The inclined wall and leading edge form a substantially continuous surface to provide a gradual transition between the door pane and the patch fitting cover when the door pane is coupled to the patch fitting. The patch fitting cap also includes at least one mounting arrangement. The mounting arrangement is constructed and arranged to attach the patch fitting cap to the patch fitting cover along an upper external region of the patch fitting cover. The attached patch fitting cap is substantially stationary relative to the patch fitting cover, and the patch fitting cap substantially covers the upper external region.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
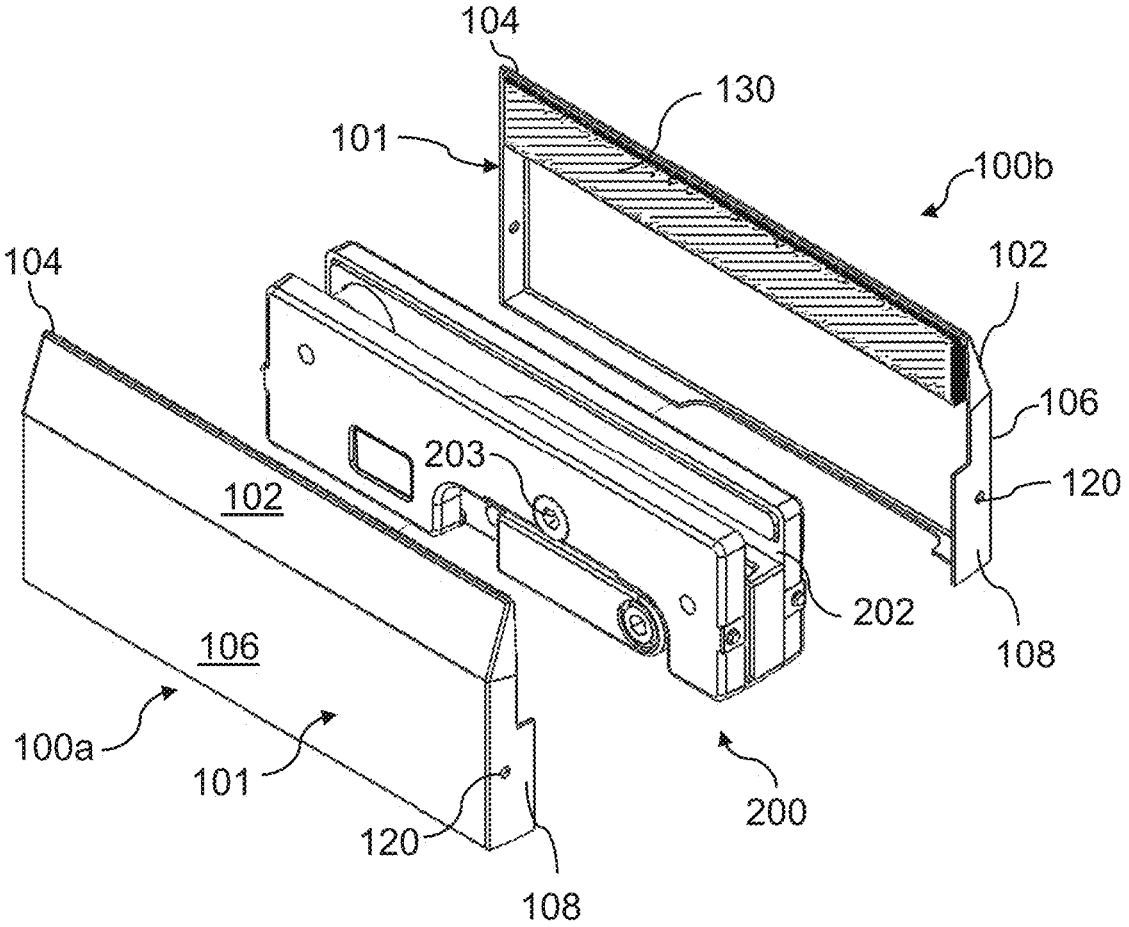
FIG. 1 depicts an exploded view of one embodiment of a patch fitting with two patch fitting covers.

In order to install a glass door, a glass door pane is conventionally clamped between two plates. Traditionally, these plates are low profile, such that they remain out of sight to improve aesthetics. In some cases, the plates are formed as a part of a patch fitting, which secures the glass door pane to a pivot point or other operable mechanisms. These patch fittings are conventionally square in shape, whereby the patch fitting is offset and projects away from the glass door pane. That is, many patch fittings meet the surface of the glass door pane orthogonally, such that the transition from an exterior surface of the distal-most portion of the patch fitting to a surface of the glass door pane is abrupt. These orthogonal patch fittings may be simple and inexpensive to manufacture and install. However, orthogonal patch fittings may not be suitable to provide accessibility for people with disabilities.

In view of the above, the inventors have recognized the benefits of a patch fitting cover with an inclined side that may be fit over a traditional patch fitting to improve accessibility without requiring expensive or complex patch fitting replacement.

According to one embodiment of the present disclosure, a patch fitting cover includes a body, the body including an inclined wall and a leading edge. The inclined wall is inclined from the surface of a glass door pane at a shallow angle (i.e., relative to the vertical or longitudinal axis of the glass door pane) such that an exterior surface of a patch fitting smoothly transitions toward the glass door pane surface. The leading edge may be a narrow, substantially horizontal surface disposed at an uppermost region of the inclined wall. Of course, the leading edge may have any suitable shape, including, but not limited to, a substantially curved or inclined shape as the present disclosure is not so limited. The leading edge may provide structural support for the inclined wall, as well as to cap (i.e., cover) any cavity or gap between the inclined wall and the glass door pane. The leading edge may abut the glass door pane, whereby the patch fitting cover to the glass door pane essentially forms a continuous surface with very little to no gap between the cover and door. The patch fitting cover may also include at least one mounting arrangement, such that the patch fitting cover may be attached to the patch fitting. When the patch fitting cover is attached to the patch fitting, the patch fitting cover is stationary relative to the patch fitting.

In some embodiments, a patch fitting cover may be removably attached to a patch fitting. According to this embodiment, the patch fitting cover may include a mounting arrangement, such as a screw attachment arrangement, where the mounting arrangement allows a user to selectively install or remove the patch fitting cover. When the patch fitting cover is installed and removably attached to the patch fitting, the patch fitting cover may be stationary relative to the patch fitting. Accordingly, during normal use, the patch fitting may resist external force, and may even serve as a push surface by which an associated glass door may be normally operated (i.e., pushed open or closed). Of course, the mounting arrangement may be any suitable removable or permanent arrangement, including, but not limited to, a mechanical fastener, snap-fit, adhesive, magnetic, or interference fit.

In some embodiments, a body of a patch fitting cover may include a vertical wall, at least one end wall, and a bottom wall. The vertical wall may be substantially parallel with an associated door surface. The vertical wall may substantially cover a vertical region of the patch fitting. The bottom wall may be substantially orthogonal to the vertical wall and cover at least a portion of a bottom region of the patch fitting. Similarly, the at least one end wall may be orthogonal to the vertical surface, and substantially cover at least one end region of the patch fitting. Accordingly, the vertical wall, bottom wall, and end wall cooperate to substantially cover the vertical region, end region, and at least a portion of the bottom region of the patch fitting. In some embodiments, the end wall may be constructed and arranged to include a mounting arrangement such that the patch fitting cover may be attached to the patch fitting. For example, the end surface may include at least one hole configured to receive a screw to attach the patch fitting cover to the patch fitting. Of course, the mounting arrangement may be any suitable arrangement and may be positioned on any patch fitting cover element or region such that the patch fitting cover may be attached to a patch fitting.

In some embodiments, the patch fitting cover may include a buffer. The buffer may be disposed on an interior side of an inclined wall of the patch fitting cover such that the buffer separates the inclined wall from a glass door pane and provides structural support for the inclined wall. In some embodiments, the buffer may be constructed and arranged as a shock absorbing material (e.g., rubber, silicon, foam, polyether plastics, etc.) such that any external force applied to the inclined wall is damped and distributed evenly to the glass door pane. According to this embodiment, the inclined wall of the patch fitting cover may resist substantial forces encountered during normal use (e.g., kicks, pushes, other impacts) without damaging the glass door pane. In other embodiments, the buffer may be a rigid material which separates an inclined wall from a glass door pane and provides structural support for the inclined wall. That is, the buffer may substantially prevent deformation of the inclined wall if a force is received by the inclined wall. Accordingly, the inclined wall may be rigid and resist forces encountered during normal use of an associated glass door. Of course, the buffer may be any suitable material and have any suitable arrangement such that the inclined wall is structurally supported by the buffer and the inclined wall is physically separated from the glass door pane.

In some embodiments, a patch fitting cover may be constructed and arranged with particular dimensions such that accessibility is improved. For example, the angle of the inclined wall relative to the vertical (i.e., vertical or longitudinal axis of an installed glass door) may be between or approximately equal to 15 and 25 degrees. Such an arrangement may create a smooth transition from the patch fitting cover to a glass door pane, thereby creating a substantially continuous surface with improved accessibility. As another example, the patch fitting cover may have a height (i.e., the distance from a bottom surface of the patch fitting cover to a leading edge of the patch fitting cover) between or approximately equal to 0.5 and 12 inches. Without wishing to be bound by theory, heights in this range may create a substantially continuous surface on which force may be applied using the feet or mobility aids. Of course, the patch fitting cover may have any suitable height such that an inclined wall of the patch fitting cover transitions gradually toward a glass door pane (as opposed to the more abrupt transition associated with a patch fitting cover that meets the door orthogonally) and creates a substantially continuous surface of the patch fitting cover toward the glass door pane. In some embodiments, a leading edge of the patch fitting cover may have a suitably narrow width. In this manner, even though the leading edge is orthogonal to the door surface, the narrower width (as compared to the wider leading edge associated with a patch fitting cover that meets the door orthogonally) results in an overall gradual transition to the door surface. For example, the leading edge may have a width between or approximately equal to 0.015 and 0.0625 inches. Of course, the leading edge may have any suitable width such that a transition between an exterior surface of the patch cover and a glass plane is substantially gradual.

Figure 7:
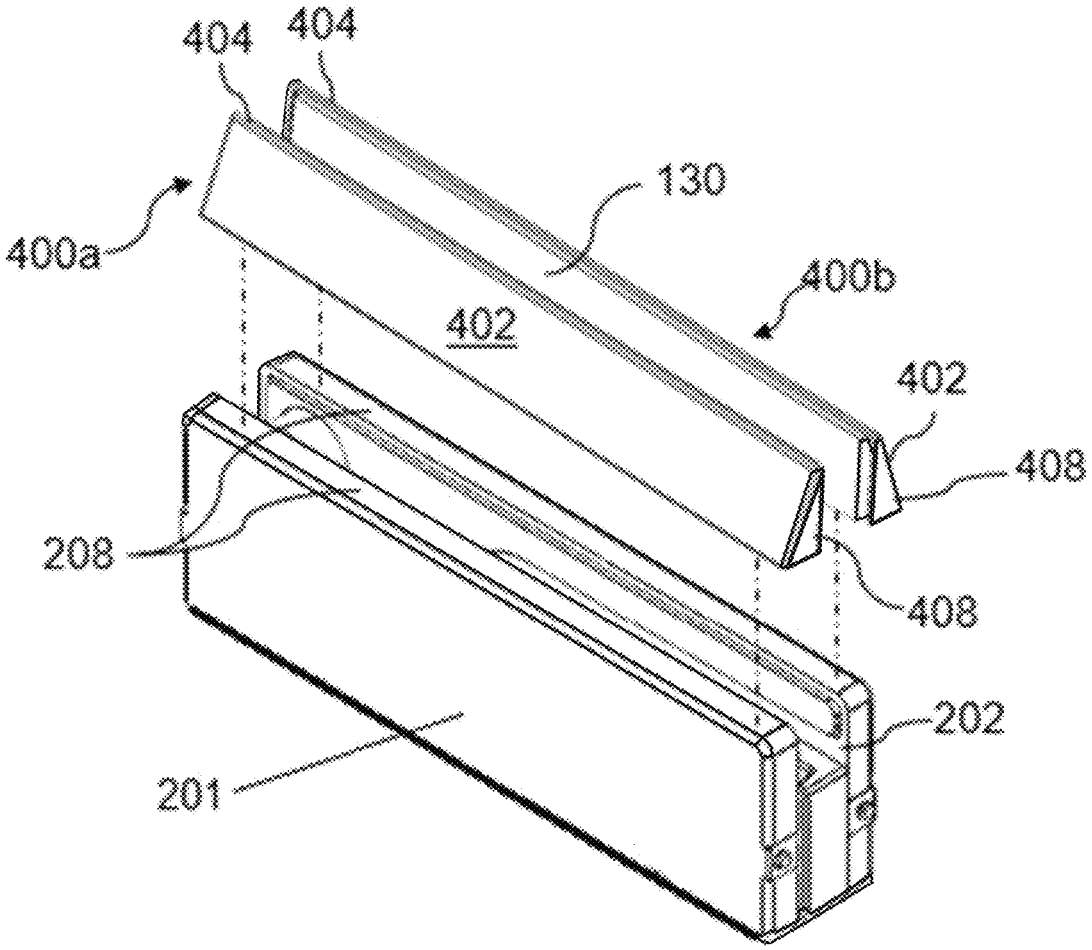
FIG. 7 is an exploded view of another embodiment of patch fitting covers.

Now turning to the figures, FIG. 1 depicts an exploded view of one embodiment of a patch fitting 200 with two patch fitting covers 100*a*, 100*b* one for each side of a glass door pane (not shown in FIG. 1 but see FIG. 7 showing the patch fitting and cover installed on a glass door). The patch fitting includes a clamping mechanism 202 and an adjustment member 203. The clamping mechanism is constructed and arranged to receive and secure the glass door pane. The adjustment member is constructed and arranged to operate the clamping mechanism. That is, the adjustment member is arranged to be manipulated to close or open the clamping mechanism to secure or release the glass door pane respectively. In the embodiment shown in FIG. 1, the adjustment member is arranged as a bolt which is turnable to adjust the width (i.e., open or close) the clamping mechanism. Of course, the adjustment member may be any suitable arrangement that may be manipulated to operate the clamping mechanism.

In the embodiment depicted in FIG. 1, each patch fitting cover 100*a*, 100*b* includes a body 101. The body includes an inclined wall 102 and a leading edge 104. The inclined wall is inclined relative to the glass door pane insert at a shallow angle such that the transition from an exterior surface of the patch fitting to the glass door pane is substantially smooth and continuous. The leading edge is a narrow horizontal surface which caps any gap between the inclined wall and the glass door pane and provides structural support for the inclined wall. The body of each patch fitting cover also includes a vertical wall 106 and at least one end wall 108. The end wall is substantially orthogonal to the vertical wall. Together, the vertical wall and end wall substantially cover an external region (i.e., region facing away or out from a glass door pane) of the patch fitting.

As shown in FIG. 1, the end wall 108 of each patch fitting cover 100*a*, 100*b* includes a hole 120, which is constructed and arranged to receive a mounting arrangement to secure the patch fitting covers to the patch fitting 200. In the depicted embodiment, the mounting arrangement may be a screw, pin, or other mechanical fastener (not shown in the figure) that is inserted through the hole on the end wall to secure the patch fitting cover to the patch fitting. Accordingly, the patch fitting covers may be removable such that any patch fitting cover may be easily swapped out with another for a different functionality. When the mounting arrangement is manipulated to attach the patch fitting cover to the patch fitting, the patch fitting cover may be stationary relative to the patch fitting. That is, normal operation of the door (i.e., pushing, kicking, and other impacts) may not detach the patch fitting cover from the patch fitting. A user may remove or otherwise manipulate the mechanical fasteners to detach the patch fitting cover. When the mounting arrangement is removed or suitably manipulated, the patch fitting cover may be removed and swapped with a different cover for a different functionality. Of course, the patch fitting cover may have any suitable permanent or removable mounting arrangement, including a mechanical fastener, adhesive, snap-fit, magnetic or interference fit, as the present disclosure is not so limited.

In the embodiment depicted in FIG. 1, each patch fitting cover 100*a*, 100*b* includes a buffer 130 constructed and arranged to physically separate the inclined wall 102 and a glass door pane and to provide structural support for the inclined wall. The buffer may be constructed of any suitable material. In some embodiments, the buffer may be constructed of a shock absorbing material, such that force received by the inclined wall is damped and distributed across a contact area of the glass door pane. For example, the shock absorbing material may include, but is not limited to, rubber, silicon, foam, and polyether plastics. According to this embodiment, the shock absorbing material may be compressed when the patch fitting cover is installed such that the patch fitting evenly abuts the glass door pane and any gaps or cavities between the patch fitting cover and the glass door pane are eliminated. In some embodiments, the buffer may be constructed of a substantially rigid material such that any external force applied to the inclined wall is transferred to a glass door pane without substantial deformation of the inclined wall. According to this embodiment, the inclined wall may remain rigid during normal use of a glass door, thereby allowing a user to apply a force on the inclined wall to open or close the door. Of course, the buffer may be constructed of any material such that the inclined wall is physically separated from the glass door pane and the inclined wall is structurally supported by the buffer.

Figure 2A:
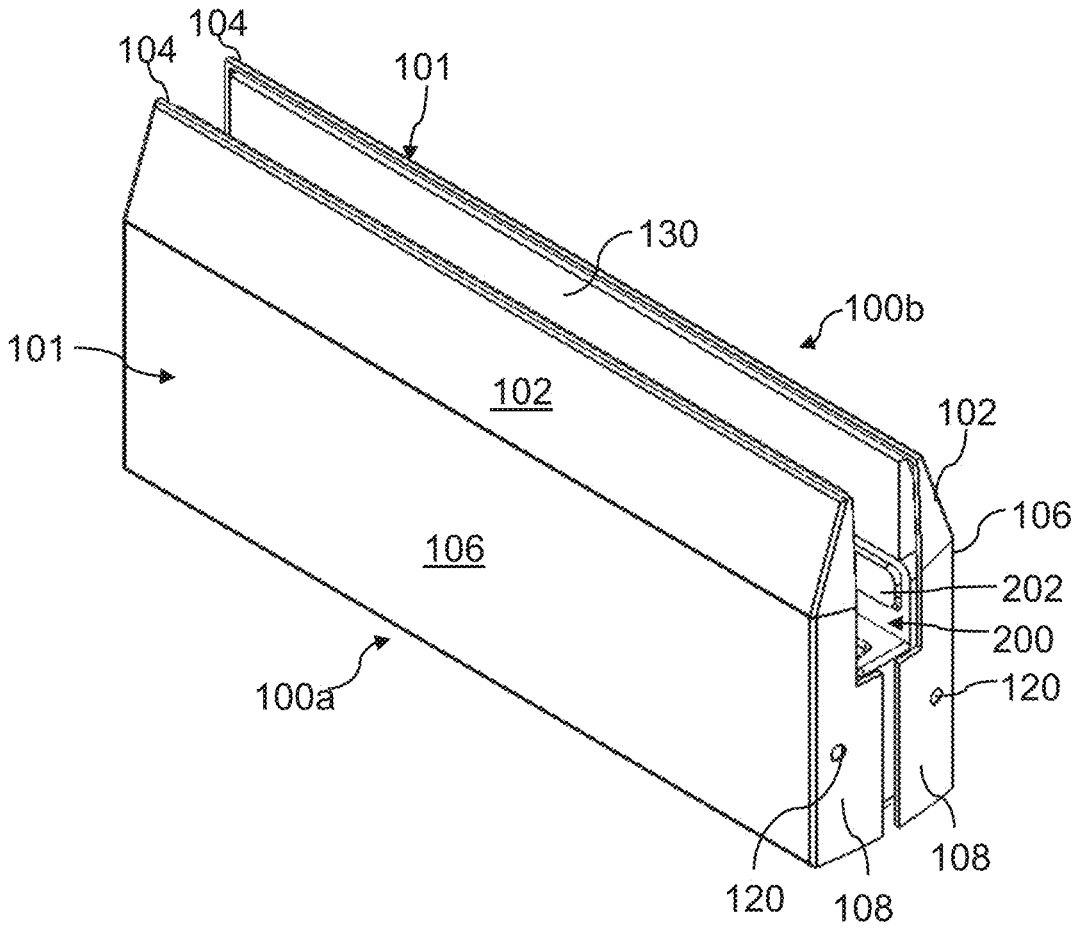
FIG. 2A depicts a perspective top view of the patch fitting and patch fitting covers of FIG. 1 with the patch fitting covers installed.

FIG. 2A depicts a perspective top view of the patch fitting 200 and patch fitting covers 100*a*, 100*b* of FIG. 1 with the patch fitting covers installed on the patch fitting. As shown in FIG. 2A, the patch fitting covers 100*a*, 100*b* substantially cover an external region of the patch fitting. As best seen in this view, the combination of the inclined wall 102, leading edge 104, vertical wall 106, and end wall 108 make the external region of the patch fitting not significantly visible. As discussed previously, the patch fitting covers are attached to the patch fitting by a mechanical fastener inserted through hole 120 such that the patch fitting covers remain stationary relative to the patch fitting.

Figure 2B:
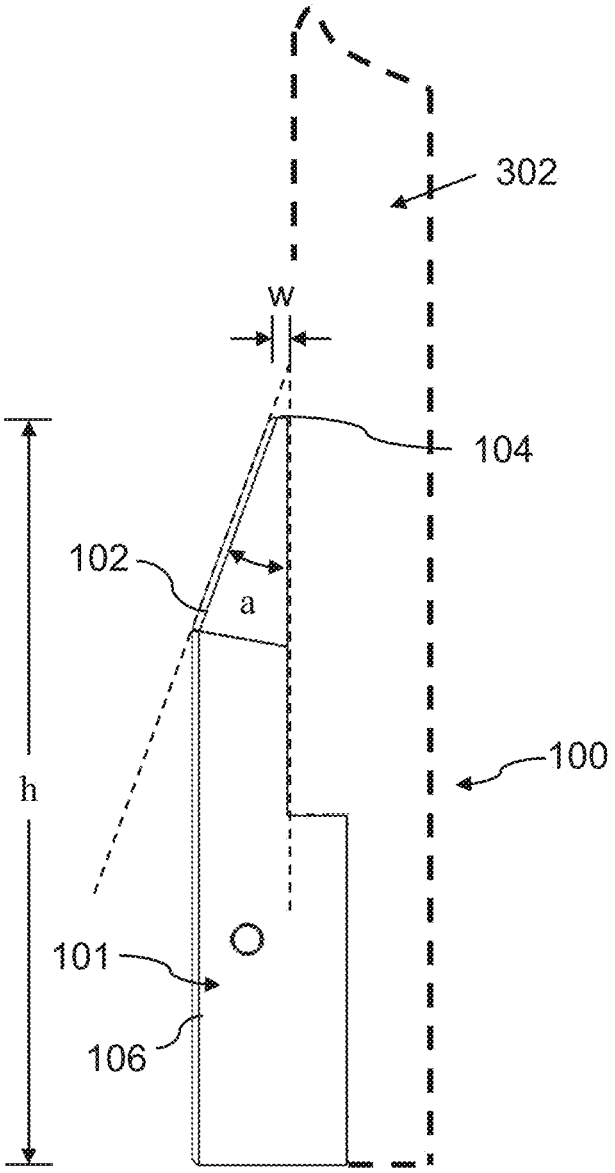
FIG. 2B depicts an elevation view of a portion of the patch fitting cover of FIG. 1.

FIG. 2B depicts an end elevation view of a patch fitting cover of FIG. 1. In some embodiments, the patch fitting covers 100*a*, 100*b* may be constructed to have particular dimensions such that accessibility is improved. As shown in FIG. 2B, a particular angle "a" of an inclined wall, the width "w" of a leading edge, and a height "h" of the patch fitting cover may affect accessibility of an associated glass door. According to the embodiment depicted in FIG. 2B, the angle "a" of the inclined wall relative to the vertical (i.e., vertical or longitudinal axis of an installed glass door pane 302 shown in dashed lines) may be between or approximately equal to 15 and 25 degrees. Additionally, in the present embodiment, the width "w" (i.e., maximum distance spanned in the horizontal direction away from the glass door) of the leading edge may be between or approximately equal to 0.015 and 0.0625 inches. Further, according to the present embodiment, the height "h" of the patch fitting cover (i.e. maximum distance spanned in the vertical direction) may be between or approximately equal to 0.5 and 10 inches.

Figure 3:
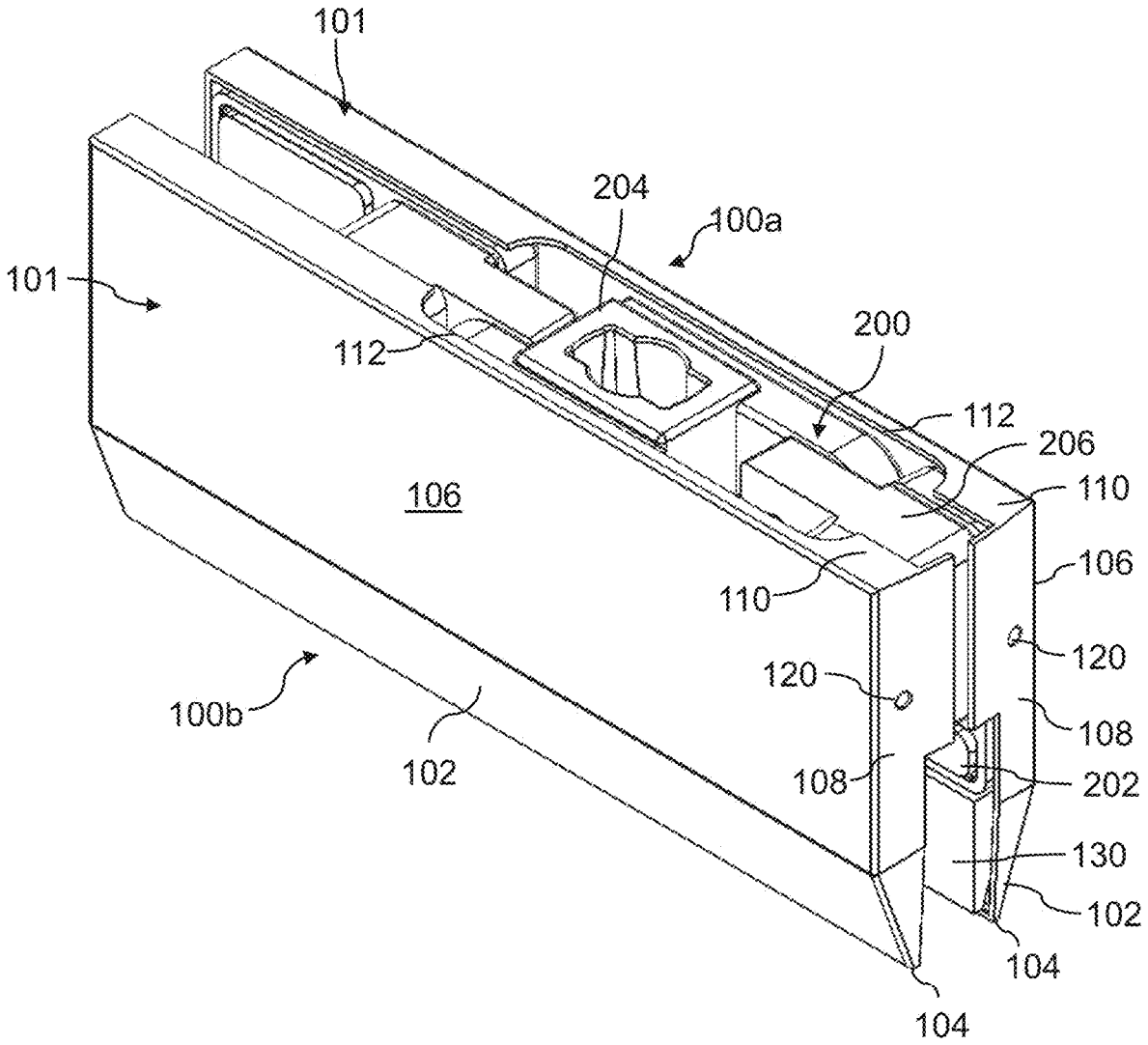
FIG. 3 depicts a perspective bottom view of the patch fitting and patch fitting covers of FIG. 1.

FIG. 3 depicts a perspective bottom view of the patch fitting 200 and patch fitting covers 100*a*, 100*b* of FIG. 1. As best seen in this view, the patch fitting cover includes a bottom wall 110. The bottom wall 110 is a substantially horizontal surface that adjoins a lowermost region of vertical wall 106 and covers at least a portion of a bottom region of the patch fitting. Accordingly, the inclined wall, vertical wall, end wall, and bottom wall substantially cover an external region of the patch fitting such that the internal components of the patch fitting are not visible or accessible during normal operation of a glass door. In some embodiments, the bottom wall may align the patch fitting cover with the patch fitting. That is, the bottom wall may aid a user in correctly positioning the patch fitting cover in the vertical direction. Accordingly, the bottom wall may make the patch fitting cover easier to install by aligning/registering the patch fitting cover to the patch fitting along at least a portion of the bottom region of the patch fitting.

As shown in FIG. 3, the patch fitting 200 may include an accessory space 204 constructed and arranged to receive and secure mounting hardware, locking hardware, or closing hardware. In some embodiments, the accessory space may be arranged to receive a hinge, such that a mounted glass door pane may be swung open or closed. In other embodiments, the accessory space may be arranged to receive a hangar, such that the mounted glass door pane may be slid open or closed. Of course, the accessory space may be any suitable arrangement such that hardware may be received by the patch fitting. As shown in FIG. 2, the bottom surface 110 of the patch fitting covers 100*a*, 100*b* each may include a cutout 112 constructed and arranged to permit the accessory space to receive hardware. Accordingly, the cutout may have any suitable dimensions such that the bottom surface does not interfere with the reception of hardware by the accessory space.

Figure 4:
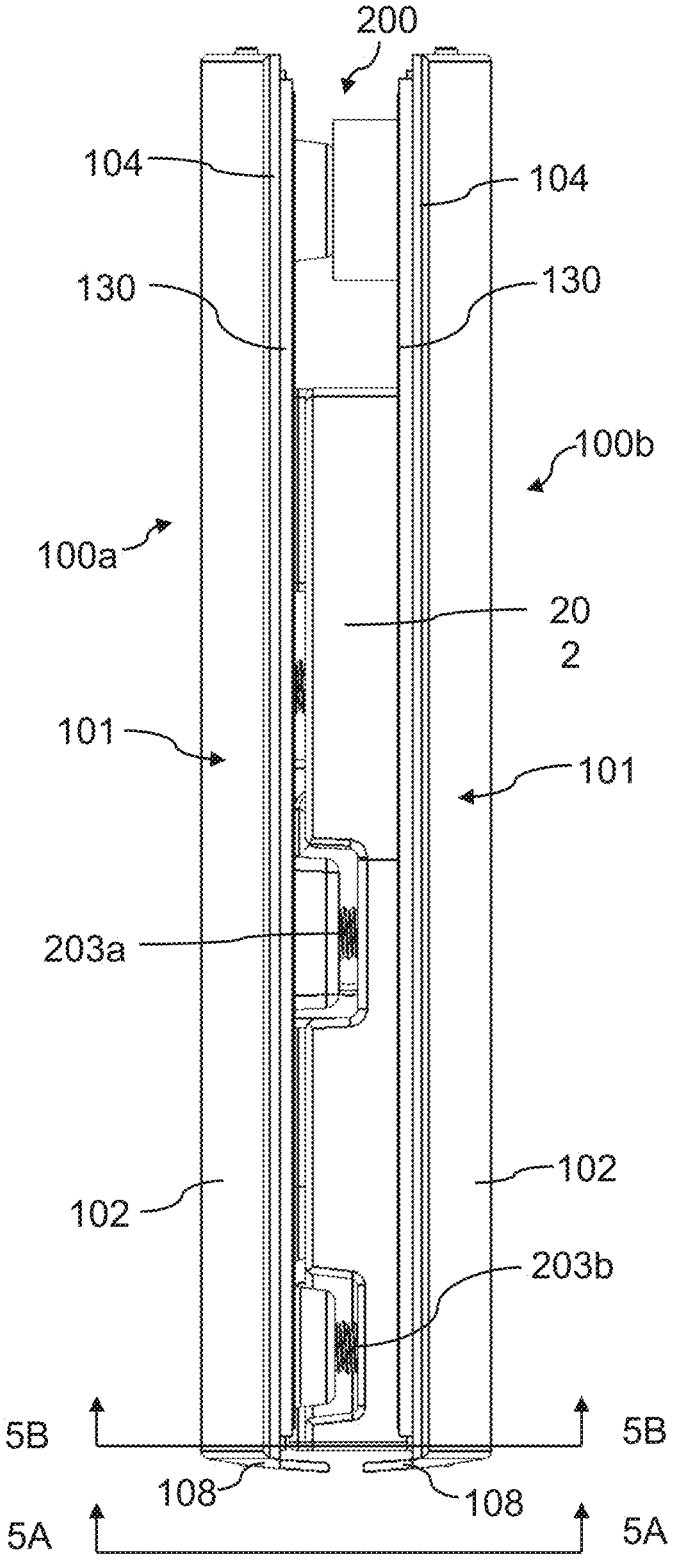
FIG. 4 depicts a top view of the patch fitting and patch fitting covers of FIG. 1.

FIG. 4 depicts a top view of the patch fitting 200 and patch fitting covers 100*a*, 100*b* of FIG. 1. As shown in FIG. 4, the patch fitting 200 includes a clamping mechanism 202 which includes a plurality of adjustment members 203. According to the embodiment depicted in FIG. 3, the adjustment members are bolts which may be turned to adjust the width of the clamping mechanism 202. Thus, by turning the bolts, a user may close the clamping mechanism and secure the patch fitting to a glass door pane inserted in the clamping mechanism. Of course, the adjustment members may be any suitable arrangement such that a glass door pane may be secured in the patch fitting.

In some embodiments, (e.g., for new installations) the patch fitting covers 100*a*, 100*b* may be installed prior to the installation of a glass door pane. In this embodiment, the patch fitting covers may be placed over the patch fitting 200 and secured, such that the patch fitting cover is stationary relative to the patch fitting. Accordingly, the glass door pane in inserted into the clamping mechanism past the buffer 130. When the clamping mechanism is closed to secure the glass door pane in the patch fitting, the patch fitting covers move closer together. Thus, the buffers are brought into abutment with the glass door pane as the clamping mechanism is closed and any gaps or discontinuities in the transition between the patch fitting and glass door pane surface are eliminated. In some embodiments, as noted above, the buffers are constructed of a shock absorbent (i.e., deformable) material such that the buffers deform against the glass door pane when the clamping mechanism is closed. Accordingly, the buffers may deform sufficiently such that the leading edge 104 of the patch fitting covers is brought into abutment with the glass door pane.

Figures 5A, 5B:
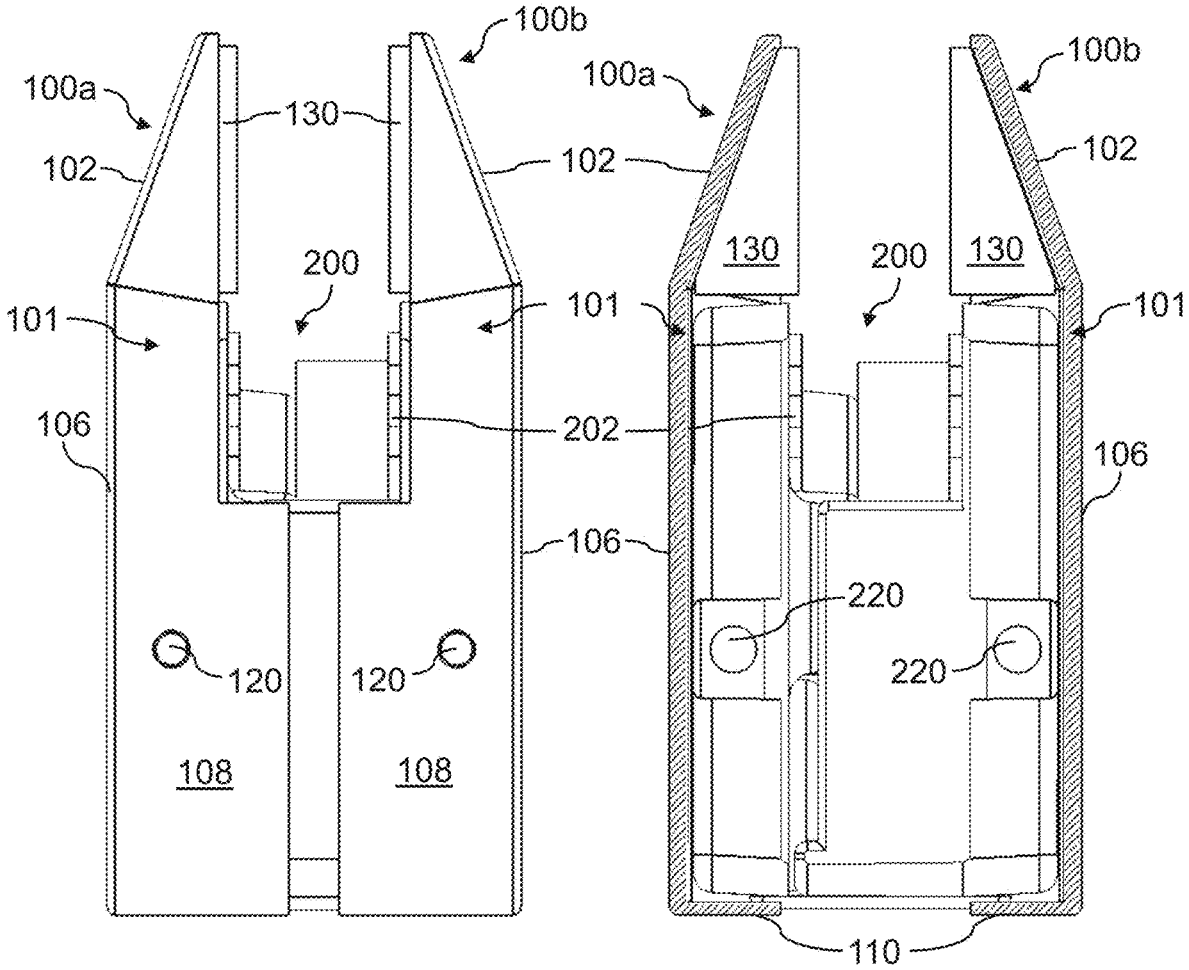
FIG. 5A is an end view taken along line 5A-5A of FIG. 4.
FIG. 5B is a cross sectional view take along line 5B-5B of FIG. 4.

FIG. 5A is an end view taken along line 5A-5A of FIG. 4 of the patch fitting 200 and patch fitting covers 100*a*, 100*b* of FIG. 1. As shown in FIG. 5A, each patch fitting includes a buffer 130 and a mounting arrangement constructed and arranged as a hole 120 configured to receive a mechanical fastener (not shown in the figure). As best shown in this view, the end wall 108 of the patch fitting cover substantially covers an external end region of the patch fitting while still allowing a glass door pane to be inserted into the patch fitting. As discussed previously, the patch fitting includes a clamping mechanism 202 which closes to secure the glass door pane in the patch fitting, and also moves the buffer into abutment with the glass door pane.

FIG. 5B shows a cross section view take along line 5B-5B of FIG. 4 of the patch fitting 200 and patch fitting covers 100*a*, 100*b*. As is clearly shown in FIG. 5B, the inclined wall 102, leading edge 104, vertical wall 106, and bottom wall 110 substantially cover an external region of the patch fitting, such that the internal components of the patch fitting are hidden from view. Each of the patch fitting covers include a buffer 130 which is constructed and arranged to physically separate the inclined wall from a glass door pane and provide structural support for the inclined wall. Accordingly, the patch fitting cover abuts both the patch fitting and the glass door pane, such that any external force (i.e., pushing force) applied to the inclined wall during normal operation of the door is transferred to the glass door pane.

As shown in FIG. 5B, the patch fitting 200 includes a clamping mechanism 202 which is constructed and arranged to be closed to secure a glass door pane in the patch fitting. The patch fitting further includes at least one mount receiver 220 arranged to receive the mounting arrangement on the patch fitting covers 100*a*, 100*b*. In the embodiment depicted in FIG. 4B, the mount receiver is a threaded hole which is arrange to receive a screw. Of course, the mount receiver may be any suitable arrangement such that any mounting arrangement of the patch fitting cover may be received. In some embodiments, the mount receive may be placed in a portion of the clamping mechanism, such that adjustment of the clamping mechanism moves the patch fitting covers relative to each other. That is, closing the clamping mechanism may move the patch fitting covers closer together, which opening the clamping mechanism may move the patch fitting covers further apart. According to this embodiment, adjustment of the clamping device may be used to bring the patch fitting covers into abutment with a glass door panel to eliminate or reduce any significant gaps or discontinuities between the glass door panel and the patch fitting cover.

Figure 6:
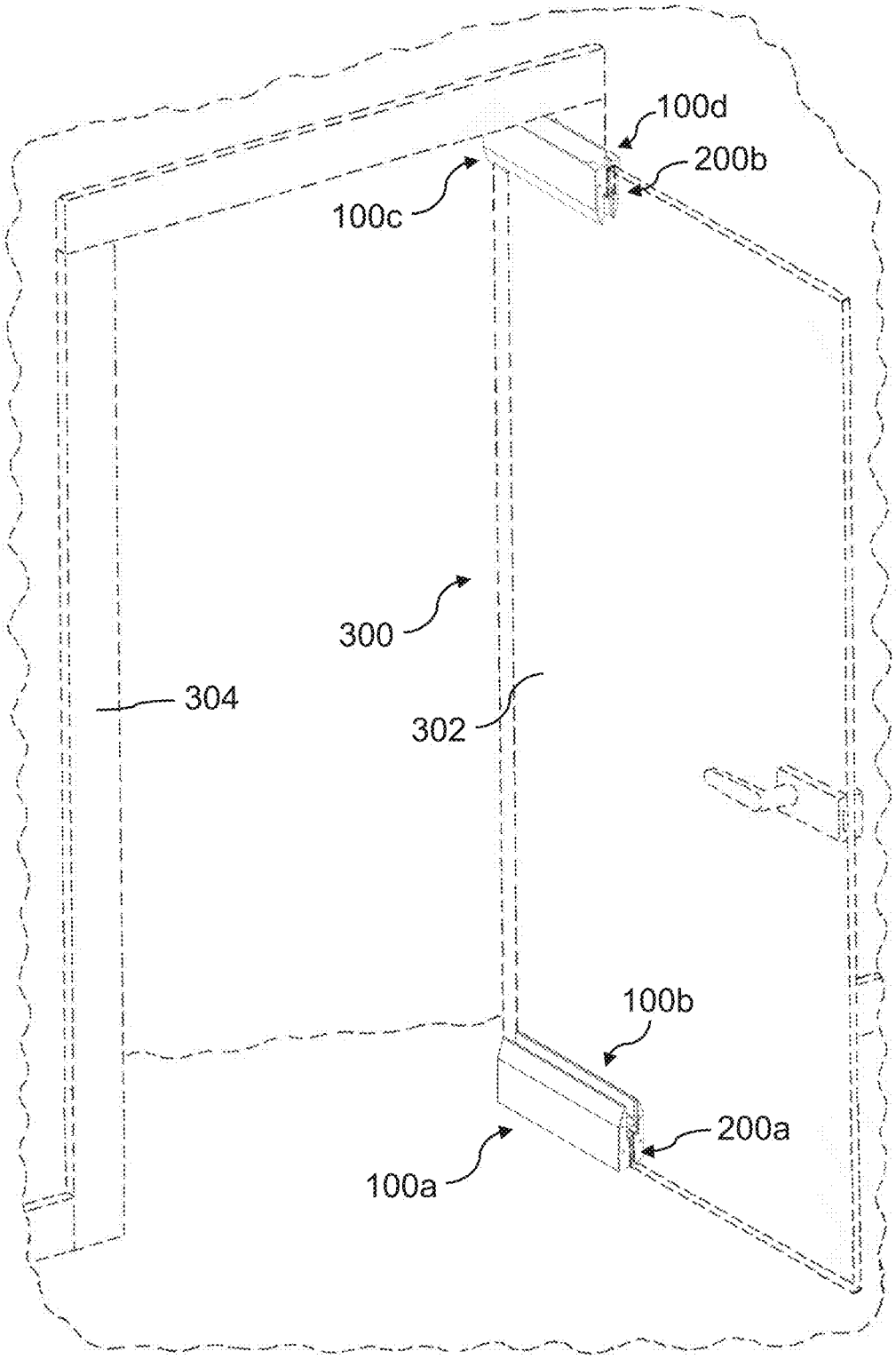
FIG. 6 depicts a view of one embodiment of a glass door including the patch fitting and patch fitting covers of FIG. 1.

FIG. 6 depicts perspective view of a glass door 300 with two patch fittings 200*a*, 200*b* with patch fitting covers 100*a*, 100*b*, 100*c*, 100*d* according to the embodiment depicted in FIG. 1. The patch fittings are coupled to each vertical end of a glass door pane 302 and door frame 304 via mounting hardware (not shown in the figure). The patch fitting covers are placed over the patch fittings, such that the patch fittings do not substantially obstruct the view through the glass door. As is clearly shown in FIG. 6, the patch fittings do not run the full width of the glass door pane, but rather run along a portion of the width of the glass door pane. In situations where the glass door and patch fitting has been previously installed having a non-inclined cover, the non-inclined cover may be swapped for the inclined patch fitting cover disclosed herein. In some other situations, an inclined patch fitting cover may be retrofit to an existing non-inclined cover. That is, the inclined patch fitting cover disclosed herein may be installed over the top of the existing conventional patch fitting and non-inclined patch fitting cover or may replace the non-inclined patch fitting cover.

FIG. 7 is an exploded view showing a conventionally covered patch fitting 200 with two patch fitting caps 400*a*, 400*b* according to one embodiment. As is clearly shown in FIG. 7, each patch fitting cap may be attached to an upper external region 208 of a conventional patch fitting cover 201. In this respect, in situations where the glass door and patch fitting has been previously installed having a non-inclined cover, the patch fitting cap 400*a*, 400*b* may be attached to the top surface of the non-inclined patch fitting cover. Each patch fitting cap includes an inclined wall 402, a leading edge 404, and an end wall 408. According to this embodiment, the inclined wall and leading edge may span a gap or discontinuity between the external region of the patch fitting and a surface of a glass door pane. Thus, the patch fitting cap may function as a gradual transition between an external region of the patch fitting and the glass door pane. Of course, the patch fitting cover may have any suitable combination of walls that cover or attach to any suitable surface of the patch fitting such that a substantially gradual and continuous surface is formed, as the present disclosure is not so limited.

As shown in FIG. 7, the patch fitting covers 400*a*, 400*b* may be attached to an upper external region 208 of the patch fitting cover 201 using a mounting arrangement (not shown in the figure). According to the present embodiment, the patch fitting caps 400*a*, 400*b* may be installed with an adhesive or magnet disposed between the upper external region 208 and a bottom region of the cap. According to the embodiment depicted in FIG. 7, the patch fitting cap may include a buffer 130 arranged to resist external forces applied to the patch fitting cover. The buffer may be arranged to distribute and transmit external forces received (e.g., pushing, kicking, etc.) to the glass door pane and/or patch fitting, such that the patch fitting cap may function as a push surface as a part of a glass door. The buffer may also provide structural support for the patch fitting cap, so that the patch fitting cap remains stationary relative to the patch fitting when external forces are received by the patch fitting cap.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A patch fitting cover for a patch fitting, the patch fitting operatively couplable to a door pane, the patch fitting cover comprising:

a body constructed and arranged to cover an external region of the patch fitting, wherein the body comprises:

an inclined planar wall inclined relative to a vertical axis of the door pane when the door pane is coupled to the patch fitting;

a leading edge substantially orthogonal relative to the door pane when the door pane is coupled to the patch fitting;

a vertical wall, wherein the inclined wall adjoins an uppermost region of the vertical wall, and wherein the vertical wall, inclined wall and leading edge form a substantially continuous surface to provide a gradual transition to the door pane when the door pane is coupled to the patch fitting; and a bottom wall at a lowermost region of the vertical wall configured to adjoin a lowermost portion of the patch fitting to vertically align the patch fitting cover with the patch fitting; and at least one mounting arrangement constructed and arranged to attach the patch fitting cover to the patch fitting.

2. The patch fitting cover of claim 1, wherein the patch fitting cover is removably attached to the patch fitting.

3. The patch fitting cover of claim 1, further comprising at least one end wall, wherein the at least one end wall adjoins a side region of at least one of the inclined wall and vertical wall, wherein the end wall is substantially orthogonal to at least one of the inclined wall and vertical wall.

4. The patch fitting cover of claim 1 further including a buffer, wherein the buffer physically separates the inclined wall from the door pane when the door pane is coupled to the patch fitting.

5. The patch fitting cover of claim 4, wherein the buffer is constructed of a shock-absorbing material.

6. The patch fitting cover of claim 1, wherein the inclined wall is inclined at an angle between or approximately equal to 15 and 25 degrees relative to a vertical surface of the door pane when the patch fitting and cover are installed on the door.

7. The patch fitting cover of claim 1, wherein the patch fitting cover has a height between or approximately equal to 0.5 and 12 inches.

8. The patch fitting cover of claim 1, wherein the leading edge has a width between or approximately equal to 0.015 and 0.0625 inches.

9. The patch fitting cover of claim 1, wherein the patch fitting cover is configured to be positioned only on a single side of the door pane.

10. A patch fitting cap for a patch fitting cover, the patch fitting cover operatively couplable to a patch fitting, the patch fitting operatively couplable to a door pane, the patch fitting cap comprising:

an inclined wall inclined relative to a vertical axis of the door pane when the door pane is coupled to the patch fitting;

a leading edge being substantially orthogonal relative to the door pane when the door pane is coupled to the patch fitting, wherein the inclined wall and leading edge form a substantially continuous surface to provide a gradual transition between the door pane and the patch fitting cover when the door pane is coupled to the patch fitting;

at least one mounting arrangement constructed and arranged to attach the patch fitting cap to the patch fitting cover along an upper external region of the patch fitting cover, wherein the attached patch fitting cap is substantially stationary relative to the patch fitting cover, and wherein the patch fitting cap substantially covers the upper external region; and a buffer, wherein the buffer physically separates the inclined wall from the door pane when the patch fitting, patch fitting cover and cap are installed on the door.

11. The patch fitting cap of claim 10, further comprising at least one end wall, wherein the at least one end wall adjoins a side region of the inclined wall and is substantially orthogonal to the inclined wall.

12. The patch fitting cap of claim 10, wherein the patch fitting cover is removably attached to the patch fitting cover.

13. The patch fitting cap of claim 10, wherein the mounting arrangement is at least one of a mechanical fastener, snap-fit, adhesive, magnetic, or interference fit.

14. The patch fitting cap of claim 10, wherein the buffer is constructed of a shock-absorbing material.

15. The patch fitting cap of claim 10, wherein the inclined wall is inclined at an angle between or approximately equal to 15 and 25 degrees relative to a vertical surface of the door pane when the patch fitting, patch fitting cover and cap are installed on the door.

16. The patch fitting cap of claim 10, wherein the leading edge has a width between or approximately equal to 0.015 and 0.0625 inches.

17. A patch fitting cover for a patch fitting, the patch fitting operatively couplable to a door pane, the patch fitting cover comprising:

a body constructed and arranged to cover an external region of the patch fitting, wherein the body comprises:

an inclined wall inclined relative to a vertical axis of the door pane when the door pane is coupled to the patch fitting;

a leading edge substantially orthogonal relative to the door pane when the door pane is coupled to the patch fitting; and a vertical wall, wherein the inclined wall adjoins an uppermost region of the vertical wall, and wherein the vertical wall, inclined wall and leading edge form a substantially continuous surface to provide a gradual transition to the door pane when the door pane is coupled to the patch fitting;

at least one mounting arrangement constructed and arranged to attach the patch fitting cover to the patch fitting, wherein the patch fitting cover is configured to be positioned only on a single side of the door pane.

18. The patch fitting cover of claim 17, wherein the patch fitting cover is removably attached to the patch fitting.

19. The patch fitting cover of claim 17, wherein the inclined wall is inclined at an angle between or approximately equal to 15 and 25 degrees relative to a vertical surface of the door pane when the patch fitting and cover are installed on the door.

20. The patch fitting cover of claim 17, wherein the leading edge has a width between or approximately equal to 0.015 and 0.0625 inches.

21. The patch fitting cover of claim 17, wherein the body further comprises a bottom wall at a lowermost region of the vertical wall configured to adjoin a lowermost portion of the patch fitting to vertically align the patch fitting cover with the patch fitting.

22. The patch fitting cover of claim 17, further comprising a buffer, wherein the buffer physically separates the inclined wall from the door pane when the door pane is coupled to the patch fitting.

* * * * *